US007646353B2

(12) United States Patent
Lu et al.

(10) Patent No.: US 7,646,353 B2
(45) Date of Patent: Jan. 12, 2010

(54) ANTENNA STRUCTURE AND METHOD FOR INCREASING ITS BANDWIDTH

(75) Inventors: Jung Chieh Lu, Taipei County (TW); Hsin Chung Li, Taoyuan County (TW)

(73) Assignee: Delta Networks, Inc., Taoyuan (TW)

( * ) Notice: Subject to any disclaimer, the term of this patent is extended or adjusted under 35 U.S.C. 154(b) by 146 days.

(21) Appl. No.: 11/772,941

(22) Filed: Jul. 3, 2007

(65) Prior Publication Data

US 2008/0158085 A1 Jul. 3, 2008

(30) Foreign Application Priority Data

Dec. 29, 2006 (TW) ..... 95150088 A

(51) Int. Cl.
*H01Q 9/28* (2006.01)
*H01Q 19/10* (2006.01)

(52) U.S. Cl. ..... 343/795; 343/818

(58) Field of Classification Search ..... 343/700 MS, 343/795, 817, 818
See application file for complete search history.

(56) References Cited

U.S. PATENT DOCUMENTS

| | | | | |
|---|---|---|---|---|
| 6,339,405 | B1 * | 1/2002 | Gleener | 343/795 |
| 7,295,162 | B2 * | 11/2007 | Wang et al. | 343/700 MS |
| 2004/0080464 | A1 * | 4/2004 | Suganthan et al. | 343/795 |
| 2008/0094283 | A1 * | 4/2008 | Mei | 343/700 MS |

* cited by examiner

*Primary Examiner*—Hoang V Nguyen
(74) *Attorney, Agent, or Firm*—Volpe and Koenig, P.C.

(57) ABSTRACT

An antenna structure and a method for increasing an antenna bandwidth are provided. The antenna structure includes a feeding portion, a first resonating element electrically connected to the feeding portion, a protruding portion electrically connected to the feeding portion, and a second resonating element coupled with the protruding portion.

10 Claims, 5 Drawing Sheets

ANTENNA STRUCTURE AND METHOD FOR INCREASING ITS BANDWIDTH

FIELD OF THE INVENTION

The present invention is related to an antenna structure, and more particularly to an antenna structure with a wide bandwidth.

BACKGROUND OF THE INVENTION

As to an antenna structure, i.e. the present dipole antenna, it is not easy to carry because of its size. For the present radio frequency identification (RFID), it could be easy to carry with users by providing a conventional meander line antenna (MLA), which is folded at least once for reducing its size.

Please refer to FIG. 1, which is a plan view showing a conventional meander line antenna. An inner-folding dipole antenna 1 includes a first dipole antenna 12 and a second dipole antenna 14. The first dipole antenna 12 and the second dipole antenna 14 are folded toward each other, respectively. Further, the first dipole antenna 12 and the second dipole antenna 14 are matched with a feeding point via a T-shaped network T. However, the length and the width of the inner-folding dipole antenna 1 are respectively 79 mm and 53 mm because of the limited dimensions for its half-wavelength.

Please refer to FIG. 2, which is a plan view showing a further conventional meander line antenna. A meander-line dipole antenna 2 includes a feeding portion 20 and a coupled loop 22 formed thereon. Further, there is a parasitic element 24 near to the coupled loop 22 for being coupled therewith. The parasitic element 24 is still made by the mentioned folding process. However, the length and the width of the meander-line dipole antenna 2 are respectively 80 mm and 17 mm because of its limited half-wavelength.

Please refer FIG. 3, which is a plan view showing a conventional dipole antenna. This is a radio frequency identification tag (RFID tag) 3 for Texas Instruments (TI). The RFID tag 3 includes a feeding portion 30 and a dipole antenna 32. Besides, there is a loop structure 34 near to the feeding portion 30 for increasing the matching inductance. However, the length and the width of the meander-line dipole antenna 2 are respectively 95 mm and 38 mm based on the limited factor for the half-wavelength.

According to above-mentioned description, the dimensions of all conventional antennas could be reduced by folding the antenna under a fixed bandwidth. Moreover, the dimensions of the antenna are limited by wavelength and frequency, and the available frequency is subject to the environment of the antenna. The bandwidth of the mentioned conventional antennas is between 70 MHz and 100 MHz. Accordingly, it is common to use the process for re-folding the antenna if the dimensions thereof would be further reduced. However, the characteristics of the antenna would be changed, and a quality factor (Q factor) is further reduced and the bandwidth thereof is further narrowed. Thus, such process is not available. Therefore, it is an important issue applied in this field of the antenna to reduce the dimensions of the antenna and maintain an original bandwidth thereof.

Therefore, the purpose of the present invention is to develop an antenna structure and a method for increasing its bandwidth to deal with the above situations encountered in the prior art.

SUMMARY OF THE INVENTION

It is therefore a first aspect of the present invention to provide an antenna structure and a method for increasing its bandwidth by providing a second resonating point in the antenna structure having a first resonating point, thereby increasing the bandwidth thereof via the second resonating point.

It is therefore a second aspect of the present invention to provide an antenna structure and a method for increasing its bandwidth could reduce the dimensions of the antenna structure and maintain or increase the 1 bandwidth thereof.

According to a third aspect of the present invention, an antenna structure is provided. The antenna structure includes a feeding portion, a first resonating element electrically connected to the feeding portion, a protruding portion electrically connected to the feeding portion, and a second resonating element, coupled with the protruding portion.

Preferably, the protruding portion is located between the feeding portion and the first resonating element.

Preferably, the second resonating element includes a coupled portion near to the protruding portion for being coupled therewith.

Preferably, the respective first resonating element, the protruding portion, and the second resonating element are symmetric structures with respect to the feeding portion.

Preferably, the antenna structure is a dipole antenna.

According to a fourth aspect of the present invention, a method for increasing an antenna bandwidth is provided. The method includes steps of providing a feeding portion, providing a first resonating element driven by the feeding portion and having a first peak frequency, and providing a second resonating element driven by the feeding portion and having a second peak frequency, wherein the second peak frequency is different from the first peak frequency.

The method further includes a step of providing a protruding portion electrically connected to the feeding portion, whereby the second resonating element is coupled with the protruding portion.

Preferably, the second resonating element includes a coupled portion near to the protruding portion through which the second resonating element is resonated therewith.

Preferably, the feeding portion is electrically connected to the first resonating element.

Preferably, the difference between the second peak frequency and the first peak frequency is 50 MHz.

According to a fifth aspect of the present invention, a method for increasing an antenna bandwidth is provided. The method includes steps of providing an antenna structure having a first resonating point, and setting up a second resonating point for the antenna structure, so that the antenna bandwidth of the antenna structure is increased via the second resonating point.

Preferably, the antenna structure includes a feeding portion.

Preferably, the first resonating point is a first resonating element electrically connected to the feeding portion.

Preferably, the antenna structure further includes a protruding portion and a second resonating element, and the protruding portion is electrically connected to the feeding portion and coupled with the second resonating element, so as to make the second resonating element serve as the second resonating point.

Preferably, the first resonating element and the second resonating element are respectively dipole antennas and are symmetrically arranged with respect to the feeding portion.

Preferably, the protruding portion is a stub.

The above contents and advantages of the present invention will become more readily apparent to those ordinarily skilled in the art after reviewing the following detailed descriptions and accompanying drawings, in which:

BRIEF DESCIPTION OF THE DRAWINGS

DETAILED DESCRIPTION OF THE PREFERRED EMBODIMENTS

The present invention will now be described more specifically with reference to the following embodiment. It is to be noted that the following descriptions of preferred embodiment of this invention are presented herein for purposes of illustration and description only; it is not intended to be exhaustive or to be limited to the precise form disclosed.

Figure 1:
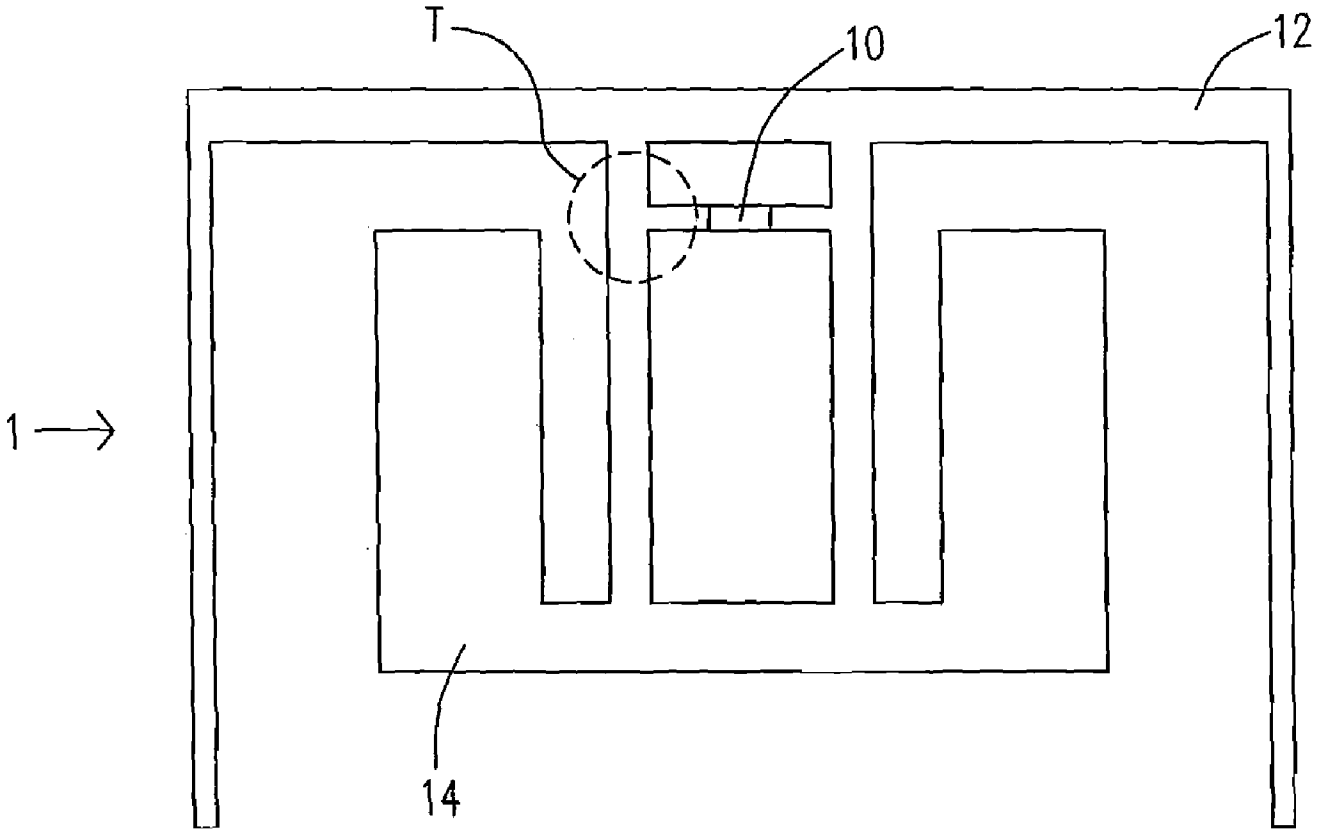
Fig. 1 (PRIOR ART)
FIG. 1 is a plan view showing a conventional meander line antenna.
Figure 2:
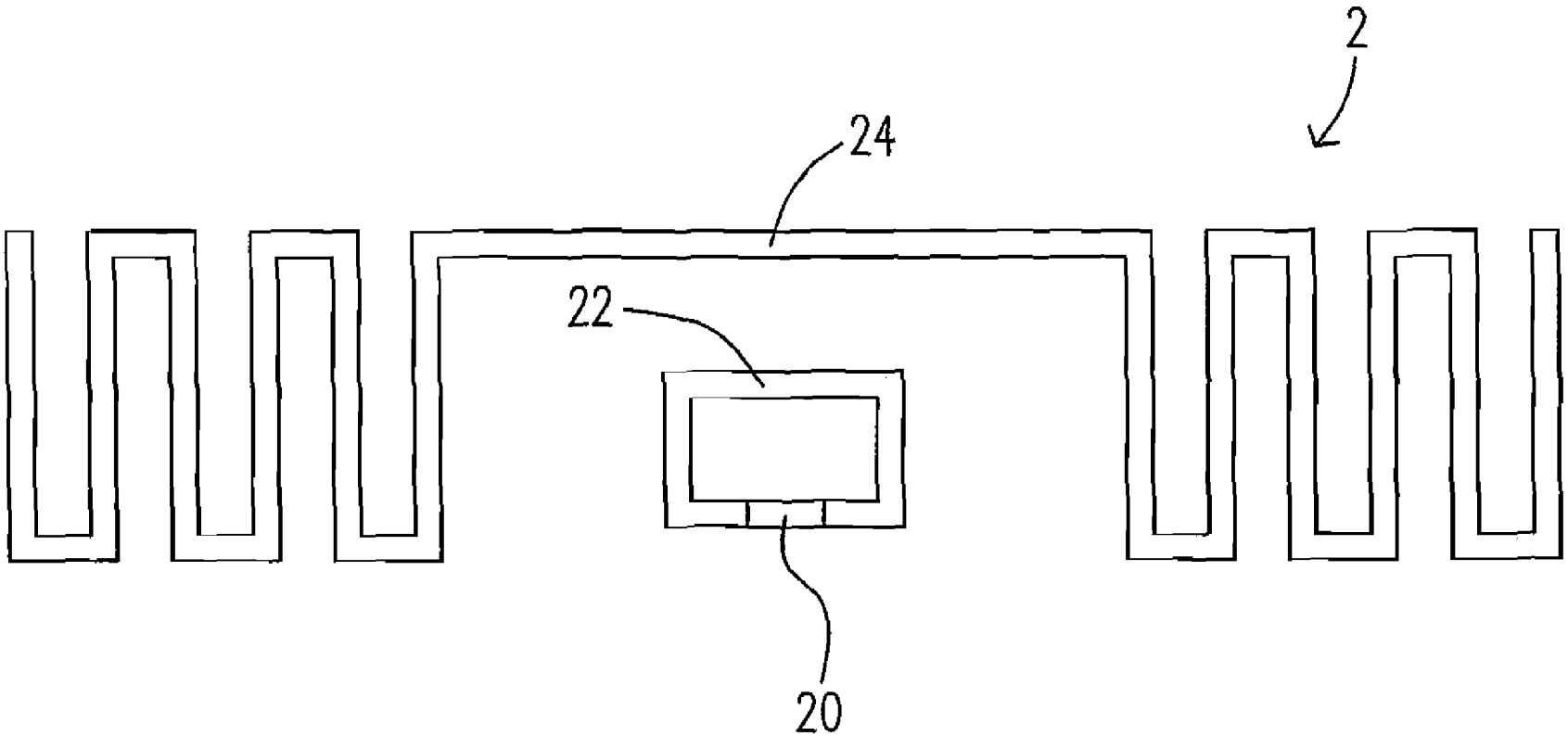
Fig. 2(PRIOR ART)
FIG. 2 is a plan view showing a further conventional meander line antenna.
Figure 3:
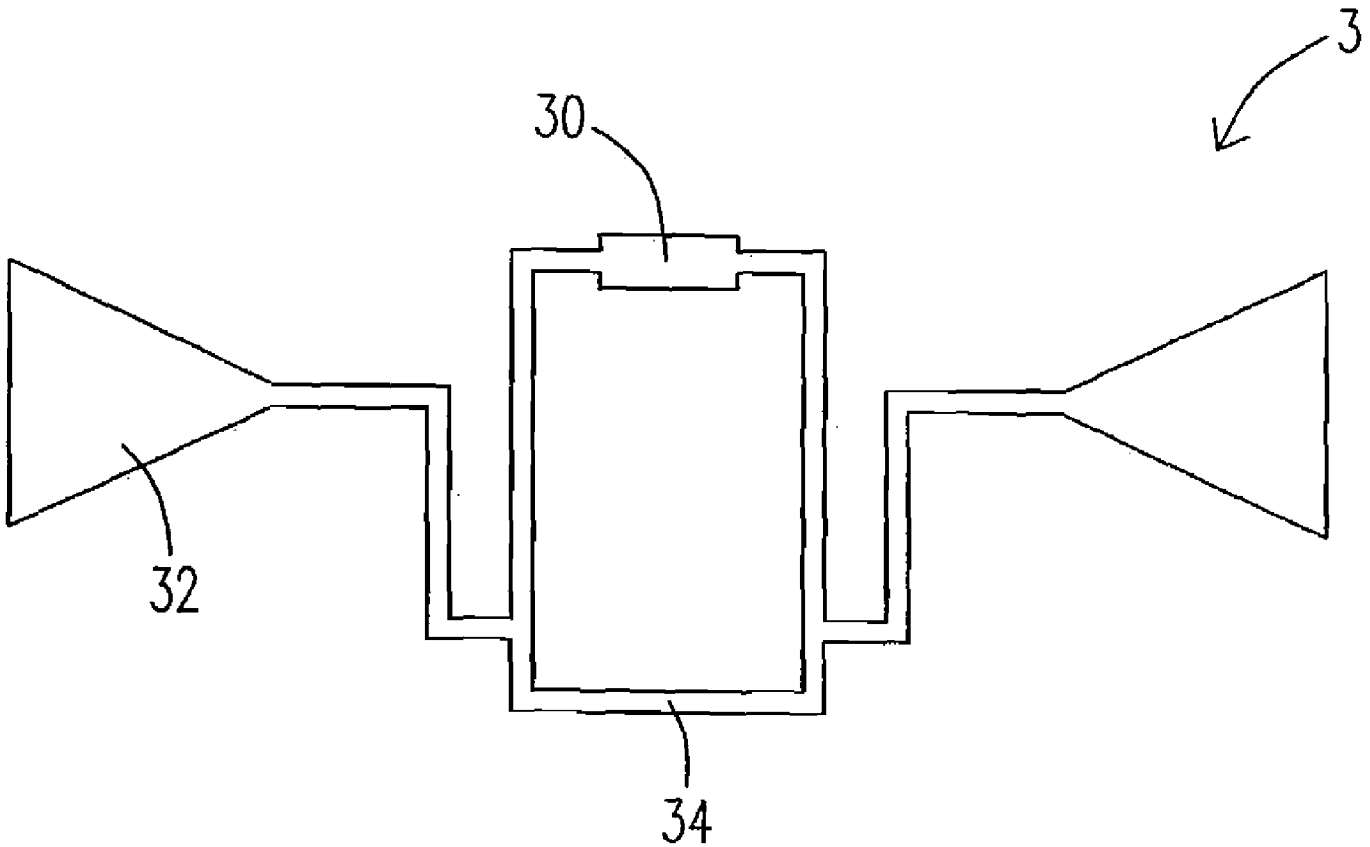
Fig. 3(PRIOR ART)
FIG. 3 is a plan view showing a conventional dipole antenna.
Figure 4:
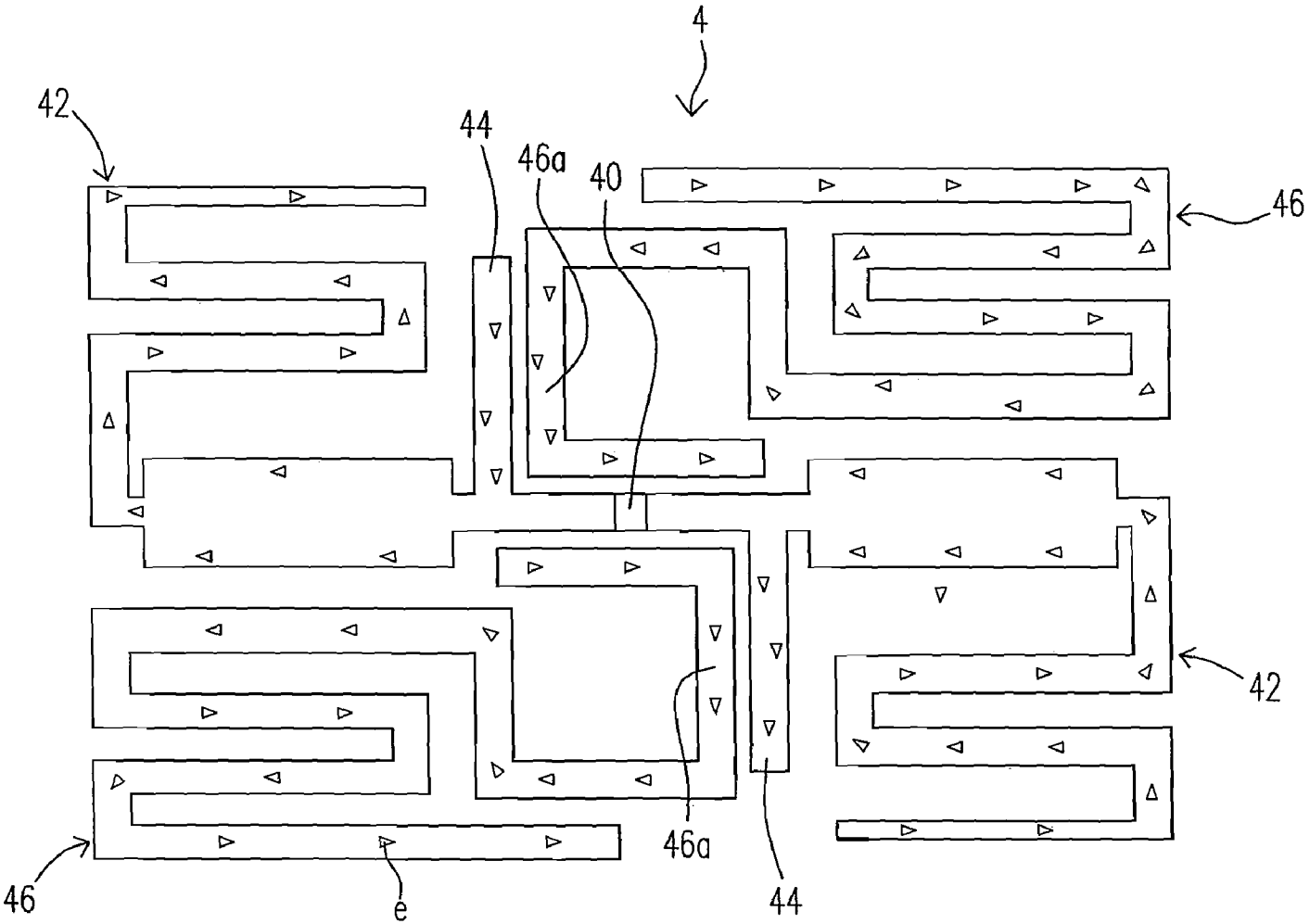
FIG. 4 is a schematic view showing an antenna structure and its current direction according to a preferred embodiment of the present invention.

Please refer to FIG. 4, which is a schematic view showing an antenna structure and its current direction according to a preferred embodiment of the present invention. An antenna structure 4 includes a feeding portion 40 electrically connected to a first resonating element 42. Since the first resonating element 42 is a dipole antenna, the first resonating element 42 is symmetrically arranged with respect to the feeding portion 40. Further, a protruding portion 44 is near by the feeding portion 40. The protruding portion 44 is extended from a segment between the feeding portion 40 and the first resonating element 42 and is symmetrically arranged with respect to the feeding portion 40. Another antenna, i.e. a second resonating element 46, would be driven by the coupling thereof with the protruding portion 44. The respective first resonating element 42, the protruding portion 44, and the second resonating element 46 are symmetric structures with respect to the feeding portion 40. Thus, the second resonating element 46 could be arranged near to the protruding portion 44, and the second resonating element 46 includes a coupled portion 46*a* near to the protruding portion 44 through which the second resonating element 46 is resonated therewith. Accordingly, two resonating elements, i.e. the first resonating element 42 and the second resonating element 46, could be driven by the feeding portion 40, respectively. Moreover, the respective peak frequencies for the first resonating element 42 and the second resonating element 46 would be staggered so as to provide a wider bandwidth for the antenna structure 4.

As we know, the conventional meander line antenna structure merely includes a first resonating point. Thus, the present invention provides a second resonating point for increasing the bandwidth of the present antenna structure. Further, the second resonating point is generated by being coupling with a protruding portion in order to avoid the interference from the second resonating point and then generate the same current direction with the first resonating point. The first resonating point is a dipole antenna, i.e. the first resonating element 42, and the second resonating point are respectively a dipole antenna, i.e. the second resonating element 46. Accordingly, the present invention provides the feeding portion 40 serving as a symmetric point for the first resonating element 42 and the second resonating element 46, and the first resonating element 42 and the second resonating element 46 are arranged in a diagonal arrangement.

Figure 5:
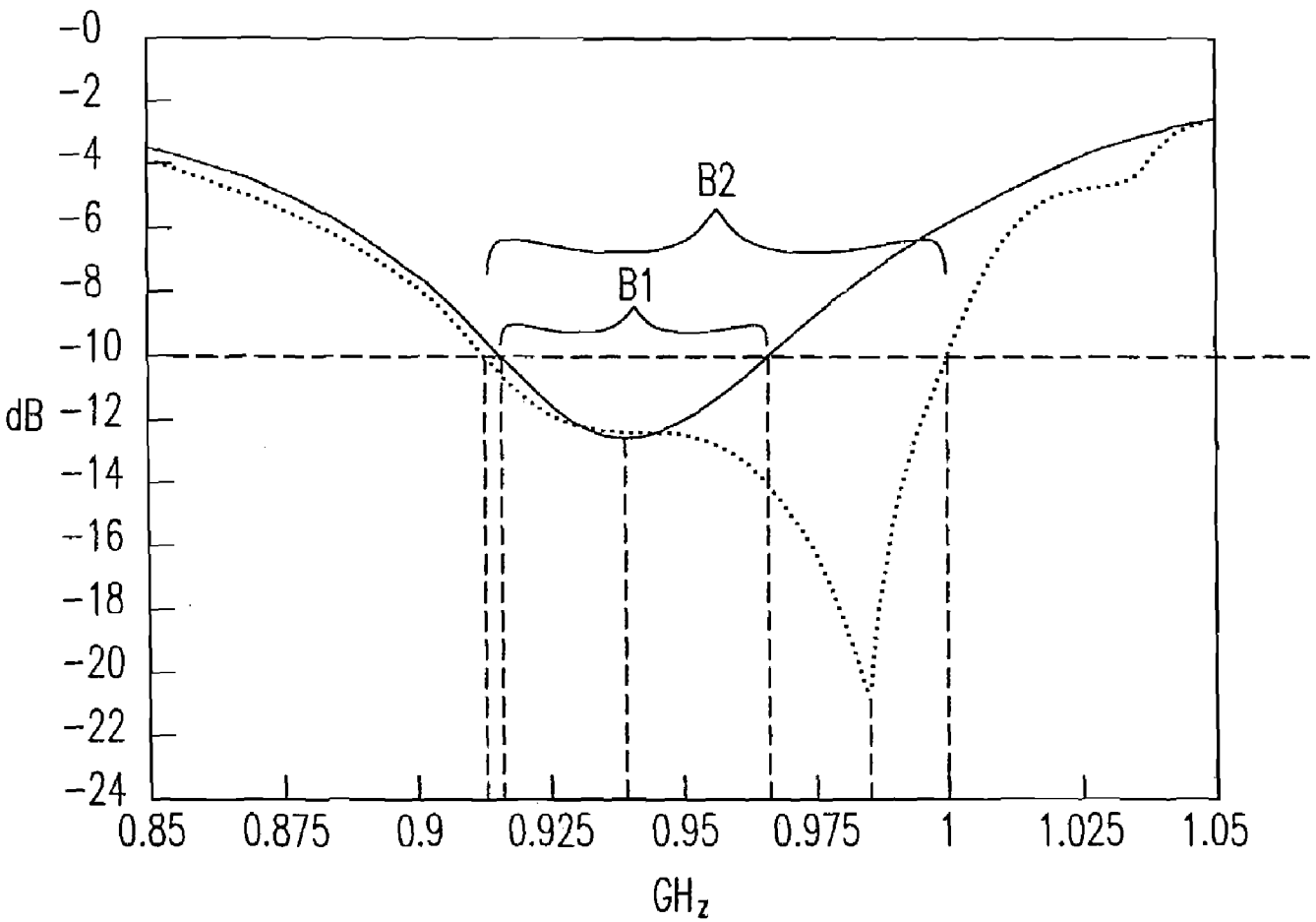
FIG. 5 is a schematic diagram showing the frequency and the attenuation of the antenna structure according to the preferred embodiment of the present invention.

Please refer to FIG. 5, which is schematic diagram showing the frequency and the attenuation of the antenna structure according to the present invention. The first resonating element 42, i.e. the first resonating point, includes a minimum attenuation (also called a first peak frequency), where the frequency of the minimum attenuation is between 925 MHz and 950 MHz. Further, the second resonating element 46, i.e. the second resonating point, includes a minimum attenuation (also called a second peak frequency), where the frequency of the minimum attenuation is between 975 MHz and 100 MHz. Referring to the attenuation of 10 dB, i.e. the gain of −10 dB, of FIG. 5, there is a first frequency band B1 between 915 MHz and 956 MHz in a condition without the second resonating element 46, i.e. the curve with a full line in FIG. 5. The bandwidth of the first frequency band B1 is merely 41 MHz. However, there is a second frequency band B2 between 912 MHz and 992 MHz in a condition with the second resonating element 46, i.e. the curve with a dotted line in FIG. 5. The bandwidth of the second frequency band B2 is 81 MHz, which is about two times of those of the first frequency band B1. That is to say, while the dimensions of the antenna would be mher reduced by folding the antenna, the Q factor would be reduced and the bandwidth thereof would be narrowed. However, the bandwidth of the present invention would be increased to about two times by adding the second resonating point.

According to the above description, it is understood that the present antenna structure and the present method for increasing its bandwidth could keep, maintain or even enhance the Q factor and the bandwidth thereof by providing the second resonating point while reducing the dimensions of the dipole antenna through folding. Further, the first resonating point and the second resonating point include different peak frequencies in the respective minimum attenuation. In addition, the respective frequency bands of the first resonating point and the second resonating point would be overlapped on the gain of −10 dB, so that the bandwidth of the antenna structure can be increased. Besides, the second resonating point is provided by coupling. Thus, the present invention provides a protruding portion, i.e. a stub, which is electrically connected to the feeding portion and coupled with the second resonating element, so as to make the second resonating element serve as the second resonating point. Since the first resonating element and the second resonating element are dipole antennas, the feeding portion of the present invention could be served as a symmetric point and the first resonating element and the second resonating element are symmetrically arranged with respect to the feeding portion. Then, the current directions of the first resonating element and the second resonating element could be identical and the performance of the present antenna structure would be enhanced.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An antenna structure, comprising:

a feeding portion;

a first resonating element electrically connected to the feeding portion;

a protruding portion electrically connected to the feeding portion; and a second resonating element coupled with the protruding portion and having a coupling portion near to the protruding portion for being coupled therewith.

2. The antenna structure according to claim 1, wherein the protruding portion is located between the feeding portion and the first resonating element.

3. The antenna structure according to claim 1, wherein the respective first resonating element, the protruding portion, and the second resonating element are symmetric structures with respect to the feeding portion.

4. The antenna structure according to claim 1, wherein the antenna structure is a dipole antenna.

5. A method for increasing an antenna bandwidth, comprising steps of:

providing a feeding portion;

providing a first resonating element driven by the feeding portion and having a first peak frequency;

providing a protruding portion electrically connected to the feeding portion; and providing a second resonating element driven by the feeding portion and having a second peak frequency, wherein the second peak frequency is different from the fist peak frequency, and the second resonating element includes a coupling portion near to the protruding portion through which the second resonating element is resonated therewith.

6. The method according to claim 5, wherein the feeding portion is electrically connected to the first resonating element.

7. The method according to claim 5, wherein the difference between the second peak frequency and the first peak frequency is 50 MHz.

8. A method for increasing an antenna bandwidth, comprising steps of:

providing an antenna structure having a first resonating element, a feeding portion, a protruding portion and a second resonating element, wherein the first resonating element is electrically connected to the feeding portion, the protruding portion is electrically connected to the feeding portion and coupled with the second resonating element, and the first resonating element and the second resonating element are dipole antennas and are symmetrically arranged with respect to the feeding portion; and setting up a second resonating point for the antenna structure, so that the antenna bandwidth of the antenna structure is increased via the second resonating point and the second resonating element is served as the second resonating point.

9. The method according to claim 8, wherein the protruding portion is a stub.

10. An antenna structure, comprising:

a feeding portion;

a first resonating element electrically connected to the feeding portion;

a protruding portion electrically connected to the feeding portion; and a second resonating element coupled with the protruding portion, wherein the antenna structure is a dipole antenna.

* * * * *